US010805724B2

(12) United States Patent
Wei et al.

(10) Patent No.: US 10,805,724 B2
(45) Date of Patent: Oct. 13, 2020

(54) SPEAKER, AUDIO DEVICE THEREOF, AND METHOD OF REGULATING FREQUENCY RESPONSE

(71) Applicant: MERRY ELECTRONICS (SUZHOU) CO., LTD., Suzhou, Jiangsu Province (CN)

(72) Inventors: Pengjiang Wei, Suzhou (CN); Juicheng Chang, Suzhou (CN); Jiechen Weng, Suzhou (CN)

(73) Assignee: MERRY ELECTRONICS (SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 16/443,242

(22) Filed: Jun. 17, 2019

(65) Prior Publication Data

US 2020/0045418 A1 Feb. 6, 2020

(30) Foreign Application Priority Data

Aug. 1, 2018 (CN) ..... 2018 1 0866656

(51) Int. Cl.
*H04R 11/00* (2006.01)
*H04R 3/04* (2006.01)
(Continued)

(52) U.S. Cl.
CPC ..... *H04R 3/04* (2013.01); *H04R 1/04* (2013.01); *H04R 1/24* (2013.01); *H04R 9/046* (2013.01)

(58) Field of Classification Search
CPC ..... H04R 1/2819; H04R 1/26; H04R 1/2807; G10K 11/172; G10D 3/02; G10H 2210/275
(Continued)

(56) References Cited

U.S. PATENT DOCUMENTS 4,168,761 A 9/1979 Pappanikolaou
6,522,759 B1 * 2/2003 Mori ..... H04R 17/00 181/160
(Continued)

FOREIGN PATENT DOCUMENTS

CN 1084689 A 3/1994
CN 104507015 A 4/2015
CN 105049981 A 11/2015

*Primary Examiner* — George C Monikang
(74) *Attorney, Agent, or Firm* — Birch, Stewart, Kolasch & Birch, LLP

(57) ABSTRACT

The invention provides a speaker, an audio device thereof, and a method of regulating frequency response. The speaker comprises a back cavity and a magnetic circuit system connected to the back cavity, and further comprises: an intermediate-frequency frequency response regulation module disposed in the back cavity for regulating a length of a first effective air passage of the back cavity where an air flow passes, such that a resonant frequency of the back cavity is equivalent to a frequency of intermediate-frequency frequency response of the speaker to be improved; and/or a high-frequency frequency response regulation module disposed in the back cavity for regulating a length of a second effective air passage of the back cavity where the air flow passes, such that the resonant frequency of the back cavity is equivalent to a frequency of high-frequency frequency response of the speaker to be improved.

14 Claims, 6 Drawing Sheets

(51) Int. Cl.
*H04R 1/04* (2006.01)
*H04R 1/24* (2006.01)
*H04R 9/04* (2006.01)

(58) Field of Classification Search
USPC ..... 381/335, 116–117, 386
See application file for complete search history.

(56) References Cited

U.S. PATENT DOCUMENTS

| | | | | |
|---|---|---|---|---|
| 2006/0088184 | A1* | 4/2006 | Ohashi ..... | H04R 7/16<br>381/430 |
| 2015/0319523 | A1 | 11/2015 | Kano et al. | |

* cited by examiner

SPEAKER, AUDIO DEVICE THEREOF, AND METHOD OF REGULATING FREQUENCY RESPONSE

CROSS-REFERENCE TO RELATED APPLICATIONS

This non-provisional application claims priority under 35 U.S.C. § 119(a) on Patent Application No. 201810866656.X filed in P.R. China on Aug. 1, 2018, the entire contents of which are hereby incorporated by reference.

BACKGROUND OF THE INVENTION

1. Field of the Invention

The invention relates to the technical field of audios, and especially to a speaker, an audio device thereof, and a method of regulating frequency response.

2. Related Art

In the traditional equivalent circuit theory, the back cavity of the speaker is often viewed as a sound container. The larger the volume is, the smaller the rigidity of the product system will be, and it is generally assumed that it only has an influence on a low-frequency sensation and a resonant frequency of the product. Due to limitation of an internal space of the system end of the product, research of the back cavity in the market mainly focuses on how to enlarge the corresponding volume, thereby improving the low-frequency sensation within the limited space. Currently, successful inventions are to fill the back cavity with powders of specific properties to regulate acoustic performance of the product. On the other hand, in order to efficiently utilize the internal space of the system end, design of the sound cavity is usually to conduct small spaces around the speaker as a sound cavity, thereby enlarging volume of the sound cavity. However, it brings some bad effects, such as, occurrence of sound resonance phenomenon, whose resonant frequency points are often located in the important intermediate-frequency band, such that valleys and peaks occur in a curve of the intermediate-frequency band of the sound pressure level (SPL) to affect acoustic performance and hearing effect, and the common solution is to stick a sound-absorbing cotton inside to add damping. As people's requirements for sound quality are getting stricter, extension of high-frequency sensation also plays a more important role. Generally, a dome is made of a material with larger hardness, or it is designed to add a dish structure on the dome.

The traditional research method of the back cavity has a relatively large limitation, so that improvement of design and adjustment of the back cavity to the product performance as defaulted by the mechanical engineers is concentrated in a low-frequency region while having no influence on other frequency band. Of course, the design of adding the sound-absorbing cotton can effectively alleviate valleys and peaks in the curve of the intermediate-frequency band, but on the other hand, it is unavoidable that addition of the sound-absorbing cotton affects other acoustic performances of the product, e.g., quality factor, resonant frequency, and amplitude. The dome extends the high-frequency sensation using the material with larger hardness and the design of the dish structure, which often allows the quality to become larger correspondingly, and lowers intermediate-frequency and low-frequency sensations.

In the prior art, the speaker box provided in the Chinese patent for utility model No. 201620769574.X, entitled "Speaker box" comprises an upper housing, a lower housing cooperating with the upper housing to form an accommodating space, a speaker unit accommodated in the accommodating space, and a cover plate covering over the upper housing and spaced apart from the speaker unit to form a back cavity; the speaker box further comprises a sound passageway communicating with the back cavity and exporting sound produced by the speaker unit outside the speaker box; the speaker unit includes a basin stand, a magnetic circuit system accommodated in the basin stand, and a vibrating system disposed below the magnetic circuit system and connected to the basin stand, a rear cavity formed between the magnetic circuit system and the vibrating system; the speaker unit further includes air holes penetrating the magnetic circuit system, the air holes communicating the rear cavity with the back cavity. The speaker box may improve high-frequency sensation of the speaker to a certain extent, but there is still no scheme to improve intermediate-frequency sensation. Moreover, the speaker box is complicated in structure.

In summary, the current speaker structure obviously has inconveniences and deficiencies in practical use, so it is necessary to make improvement.

SUMMARY OF THE INVENTION

With respect to the above deficiencies, an object of the invention is to provide a speaker, an audio device thereof, and a method of regulating frequency response, so as to improve intermediate-frequency sensation and high-frequency sensation of the speaker.

In order to achieve the above object, the invention provides a speaker, comprising a back cavity and a magnetic circuit system connected to the back cavity, and further comprising:

an intermediate-frequency frequency response regulation module disposed in the back cavity for regulating a length of a first effective air passage of the back cavity where an air flow passes, such that a resonant frequency of the back cavity is equivalent to a frequency of intermediate-frequency frequency response of the speaker to be improved; and/or a high-frequency frequency response regulation module disposed in the back cavity for regulating a length of a second effective air passage of the back cavity where the air flow passes, such that the resonant frequency of the back cavity is equivalent to a frequency of high-frequency frequency response of the speaker to be improved.

In order to achieve another object of the invention, the invention further provides an audio device comprising the speaker.

In order to achieve still another object of the invention, the invention further provides a method of regulating frequency response for the speaker, comprising:

providing the intermediate-frequency frequency response regulation module in the back cavity to regulate a length of a first effective air passage of the back cavity where an air flow passes, such that a resonant frequency of the back cavity is equivalent to a frequency of intermediate-frequency frequency response of the speaker to be improved; and/or providing the high-frequency frequency response regulation module in the back cavity to regulate a length of a second effective air passage of the back cavity where the air flow passes, such that the resonant frequency of the back cavity is equivalent to a frequency of high-frequency frequency response of the speaker to be improved The invention regulates lengths of the effective air passages in the back cavity by setting an intermediate-frequency frequency response regulation module and/or a high-frequency frequency response regulation module in the back cavity of the speaker, such that the air flow forms a spiral air flow when passing through the back cavity, and intermediate-frequency sensation and high-frequency sensation of the speaker can be improved. Moreover, addition of the intermediate-frequency frequency response regulation module and/or the high-frequency frequency response regulation module in the back cavity can replace the function of the sound-absorbing cotton to improve the curve of the intermediate-frequency sensation, while avoiding sacrifice of some performances, such as, side effects of the sound-absorbing cotton. In addition, speaking from production, it may reduce one workstation of sticking the sound-absorbing cotton, which saves costs. Extension of high-frequency sensation may be implemented by regulating design of the high-frequency frequency response regulation module, which avoids requirements for high performance materials (large hardness, small density), also replaces the function of dish, while also avoids adverse effect of falling of the intermediate-frequency and high-frequency sensations due to increase of weight.

DETAILED DESCRIPTION OF THE INVENTION

To make the object, technical solution and advantage of the invention clearer, the invention is further described in detail with reference to the accompanying drawings and embodiments. It shall be understood that references of "one embodiment", "an embodiment" and "an exemplary embodiment" in the disclosure refer to that the described embodiment may comprise special features, structures or characteristics, but it is unnecessary that each embodiment must comprise these special features, structures or characteristics. In addition, such expressions do not refer to the same embodiment. Further, when describing the special features, structures or characteristics in connect with the embodiment, no matter whether it is clearly described, it has shown that it is within the knowledge range of the person skilled in the art to combine these features, structures or characteristics with other embodiment.

Some phrases are used in the disclosure and subsequent claims to refer to specific components or parts, and the ordinary persons in the art shall understand that the technology users or manufacturers may use different nouns or terms to name the same component or part. The disclosure and subsequent claims do not use difference of names as the way of distinguishing the components or parts, but use difference of functions of the components or parts as the distinguishing standard. "Comprise" and "include" mentioned in the whole disclosure and subsequent claims are open words, so they shall be understood as "include but not limited to". In addition, the word "connect" here includes any direct or indirect electrical connection means. Indirect electrical connection means includes connection through other apparatus.

It shall be noted that in the disclosure, terms "transverse", "longitudinal", "up", "down", "front", "back", "left", "right", "vertical", "horizontal", "top", "bottom", "in", "out" that indicate direction or position relationship are based on direction or position relationship shown in the figures, and are merely to facilitate describing the invention and simplifying the description, instead of indicating or suggesting that the designated apparatus or element must have a specific direction, be constructed and operated in a specific direction, so it shall not be understood as limits to the invention.

Figure 1A:
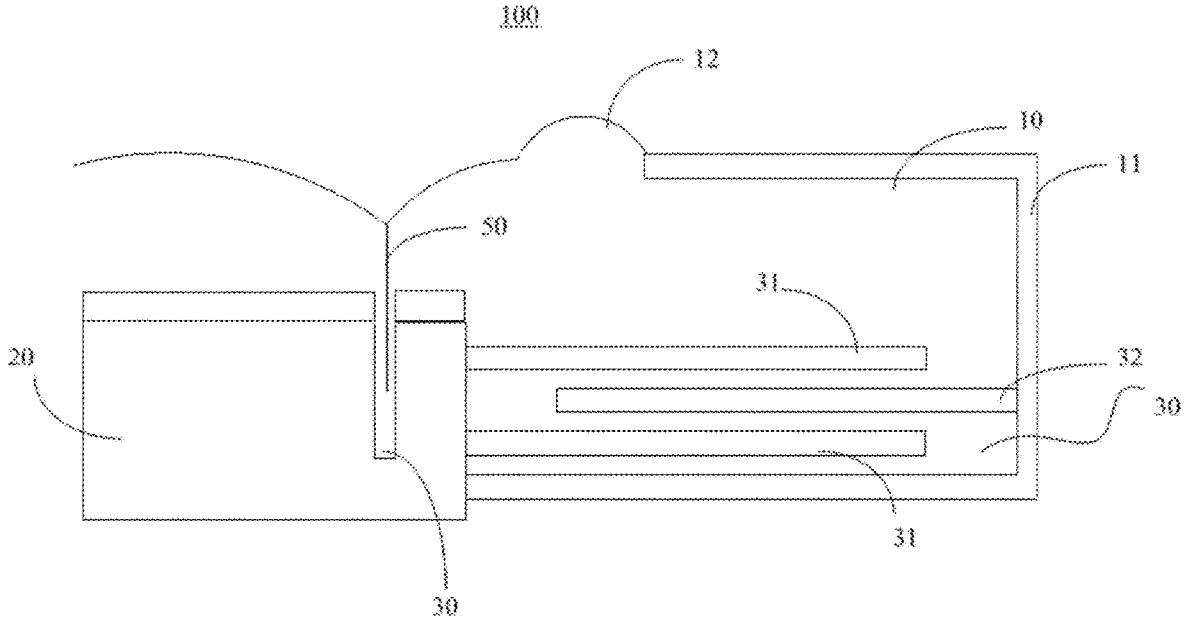
FIG. 1A is a schematic diagram of an internal structure of the speaker provided in one embodiment of the invention.
Figure 1B:
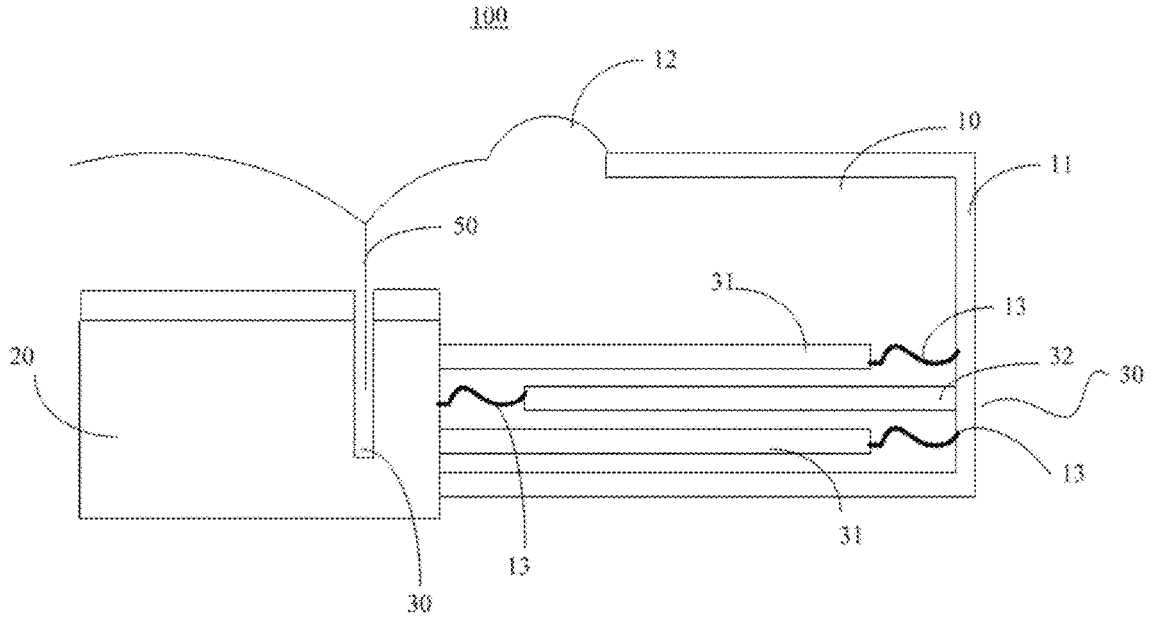
FIG. 1B is a schematic diagram of the internal structure of the speaker provided in one embodiment of the invention.
Figure 3:
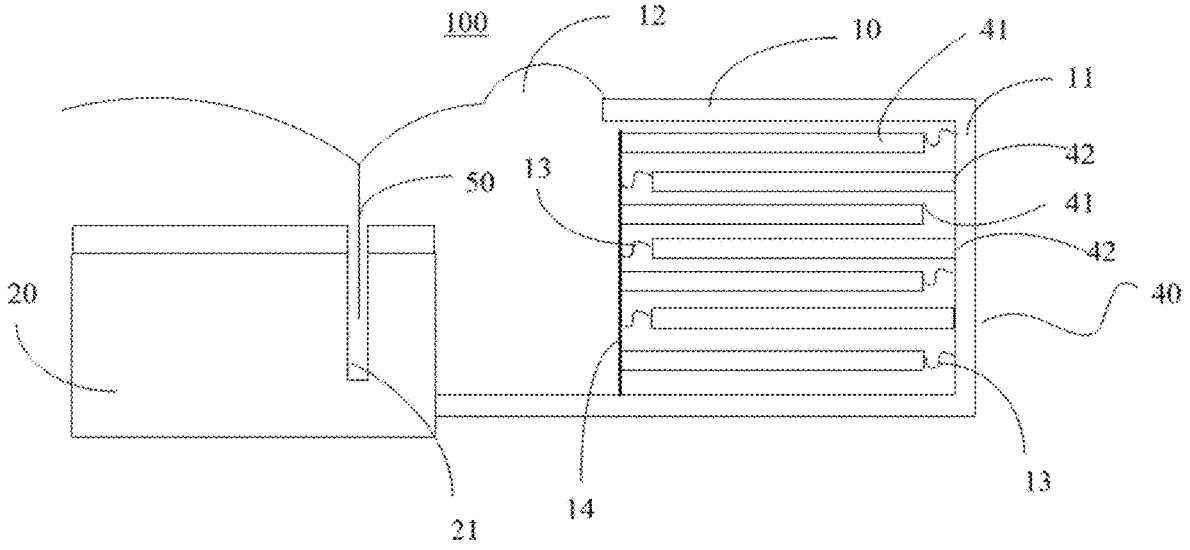
FIG. 3 is a schematic diagram of an internal structure of the speaker provided in one embodiment of the invention.

Referring to FIGS. 1A, 1B and 3, a speaker 100 comprises a back cavity 10 and a magnetic circuit system 20 connected to the back cavity 10, and further comprises:

an intermediate-frequency frequency response regulation module 30 disposed in the back cavity 10 for regulating a length of a first effective air passage of the back cavity 10 where an air flow passes, such that a resonant frequency of the back cavity 10 is equivalent to a frequency of intermediate-frequency frequency response of the speaker 100 to be improved; and/or a high-frequency frequency response regulation module 40 disposed in the back cavity 10 for regulating a length of a second effective air passage of the back cavity 10 where the air flow passes, such that the resonant frequency of the back cavity 10 is equivalent to a frequency of high-frequency frequency response of the speaker 100 to be improved.

In this embodiment, with respect to different requirements for intermediate-frequency and high-frequency sensations of the speaker 100, i.e., firstly analyzing which of the intermediate-frequency or high-frequency sensation has to be improved, a special frequency response regulation module is designed inside the back cavity 10 to produce sound field distribution of a local resonance, such that a resonant frequency of the back cavity 10 is equivalent to a frequency of intermediate-frequency frequency response of the speaker 100 to be improved, and/or the resonant frequency of the back cavity 10 is equivalent to a frequency of high-frequency frequency response of the speaker 100 to be improved, thereby improving the corresponding intermediate-frequency frequency response and high-frequency frequency response by producing a local resonant frequency in the back cavity 10. The main working principle of the scheme is based on Fabry-Perot resonance: $k_0 l_{eff} = m\pi$, wherein $k_0$ is vectors of a free wave, and $l_{eff}$ is the length of the effective air passage, wherein m is an integer. The resonant frequency can be represented as $$f_0 = \frac{mc_0}{2l_{eff}}.$$

As can be seen, regulation of the resonant frequency $f_0$ is mainly implemented by adjusting $l_{eff}$ (the length of the effective air passage). When the intermediate-frequency frequency response regulation module 30 and/or the high-frequency frequency response regulation module 40 are not disposed in the original back cavity 10, the length of the effective air passage of the back cavity 10 where the air flow passes is relatively fixed. The length of the effective air passage of the air flow in the back cavity 10 is adjusted to regulate intermediate-frequency frequency response and high-frequency frequency response by setting different intermediate-frequency frequency response regulation module 30 and high-frequency frequency response regulation module 40 in the back cavity 10. The intermediate-frequency frequency response regulation module 30 is a spiral structure of the intermediate-frequency frequency response regulation module 30 that regulates the air flow passing through the back cavity 10 to be an ascending spiral structure to improve an intermediate-frequency sensation of the speaker 100, and the high-frequency frequency response regulation module 40 is a spiral structure of the high-frequency frequency response regulation module 40 that regulates the air flow passing through the back cavity 10 to be an ascending spiral structure to improve a high-frequency sensation of the speaker 100. The air flow in the back cavity 10 is formed to be an ascending spiral structure to improve acoustic performance of the speaker 100. When the intermediate-frequency or high-frequency sensation is regulated, addition of the frequency response regulation modules almost has no influence on other performance of the speaker 100.

Referring to FIG. 1A, in one embodiment of the invention, the intermediate-frequency frequency response regulation module 30 is disposed in a lower portion of the back cavity 10, and the intermediate-frequency frequency response regulation module 30 comprises a plurality of module plates arranged horizontally or at a preset angle. Setting of these module plates can adjust the length of the first effective air passage of the back cavity 10 where the air flow passes, and these module plates can be arranged in a horizontal or inclined way.

the high-frequency frequency response regulation module 40 is disposed in the lower portion of the back cavity 10 and/or on one side close to a frame 11 of the back cavity 10, and the high-frequency frequency response regulation module 40 comprises a plurality of module plates arranged horizontally or at a preset angle. These module plates serve as tuning partition plates for improving intermediate-frequency and high-frequency sensations. In order to be adapted to other internal components of the speaker 100, the module plates are ring-shaped, and disposed in a periphery of the magnetic circuit system 20. Setting of these module plates can adjust the length of the second effective air passage of the back cavity 10 where the air flow passes, and these module plates may be arranged in a horizontal or inclined way. The module plates are ring-shaped, and adapted to the magnetic circuit system 20 and the back cavity 10. The back cavity 10 is disposed in the periphery of the magnetic circuit system 20, and a material of the module plates is metallic copper, metallic iron or polymethyl methacrylate.

Referring to FIGS. 1A and 1B, in one embodiment of the invention, preferably, the intermediate-frequency frequency response regulation module 30 comprises first module plates 31 and second module plates 32 spaced apart from each other from up to down; one end of the first module plate 31 is connected to the magnetic circuit system 20, and the other end and the frame 11 of the back cavity 10 have a gap therebetween; one end of the second module plate 32 and the magnetic circuit system 20 have a gap therebetween, and the other end is connected to the frame 11 of the back cavity 10; the first module plates 31 and the second module plates 32 have gaps therebetween. The first module plates 31 and the magnetic circuit system 20 are formed as one piece, and/or the second module plates 32 and the frame 11 are formed as one piece. For example, plastic and metal are selected to produce the frame 11, and they are formed as one piece. Alternatively, the first module plates 31 made of metal are embedded in the frame 11 during processing. In addition, as shown in FIG. 1B, the frame 11 is embedded with a plurality of connecting pieces 13, one end of the first module plate 31 is connected to the magnetic circuit system 20, and the other end is connected to the frame 11 through the connecting pieces 13. Preferably, the connecting pieces 13 are metal wires or net cloths, and the net cloths have a plurality of apertures that have no influence on flowing of the air flow in the back cavity 10. The intermediate-frequency frequency response regulation module 30 regulating the air flow passing through the back cavity 10 to be an ascending spiral structure is implemented by adjusting the number of module plates, the gaps between the module plates, the gaps between the module plates, the magnetic circuit system 20 and the frame 11 in the intermediate-frequency frequency response regulation module 30.

The intermediate-frequency frequency response regulation module 30 comprises at least two first module plates 31, and at least comprises at least one second module plate 32, gaps between a plurality of the first module plates 31 and the frame 11 are equal or unequal, and gaps between a plurality of the first module plates 31 and the second module plates 32 are equal or unequal. A length of the first effective air passage is regulated by adjusting number of the first module plates 31 and the second module plates 32 and sizes of the gaps. For example, increasing or decreasing the number of the first module plates 31 and the second module plates 32, and narrowing or widening the gaps between the plurality of first module plates 31 and the frame 11 change the length of the first effective air passage. For example, after experiments, in a structure of the speaker 100 without the intermediate-frequency frequency response regulation module 30, when the intermediate-frequency frequency of the speaker 100 is 3,665 HZ, peaks are produced. After the intermediate-frequency frequency response regulation module 30 is added, different experiments on the intermediate-frequency frequency response regulation module 30 of the speaker 100 are made, such as, narrowing the gaps between the first module plates 31 and the second module plates 32, narrowing the gaps between the first module plates 31 and the frame 11, moving the produced peaks to the left, and reducing peak values to improve intermediate-frequency sensation.

Figure 2:
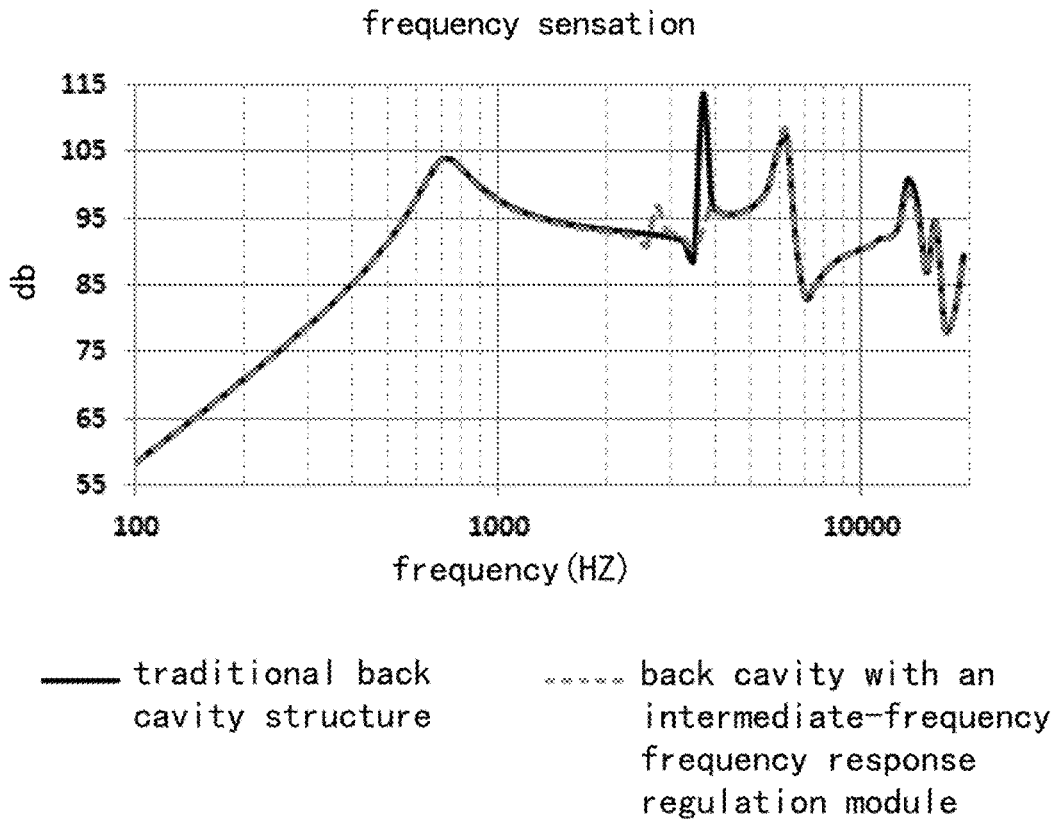
FIG. 2 is a comparison diagram of frequency sensations of the speaker with and without an intermediate-frequency frequency response regulation module provided in the embodiment of the invention.

As for improvement of the intermediate-frequency sensation, the design of adding the intermediate-frequency frequency response regulation module 30 in the back cavity 10 is illustrated in FIG. 1, which produces local resonance, thereby improving intermediate-frequency sensation. Here, the added intermediate-frequency frequency response regulation module 30 comprises a plurality of module plates, and these module plates are substantially not spiral structures. These module plates are mainly disposed proximate to the lower portion of the back cavity 10, and are sequentially arranged in such a way that one is close to the magnetic circuit system 20 and spaced apart with the frame 11, and one is spaced apart with the magnetic circuit system 20, so the air flow in the back cavity 10 passes through the gaps between the plates and the frame 11, the gaps between adjacent two plates, and the gaps between the module plates and the magnetic circuit system 20, which form the first effective air passage, and the air flow passes through the first effective air passage to ascend to form the spiral structure, thereby improving the intermediate-frequency sensation. The module plates might not be necessarily arranged horizontally, and it can be arranged in an inclined way. The distance between the plates, and the distance from the module plates to the magnetic circuit system 20 and the frame 11 can be regulated according to actual situations, so as to regulate the intermediate-frequency sensation to optimal. During regulation of the intermediate-frequency sensation, it substantially won't affect variation of the sensation curves of other frequency bands. The module plates in the intermediate-frequency frequency response regulation module 30 are often solids (copper, iron, etc) with larger hardness, PMMA (polymethyl methacrylate) and the like. Sensation results of the back cavity 10 with and without the intermediate-frequency frequency response regulation module 30 are shown in FIG. 2, where the original sharp frequency response peak becomes smooth, while newly producing a corresponding resonant peak to increase the intermediate-frequency sensation, and the sensation curve of other frequency band is substantially unchanged.

Referring to FIG. 3, in one embodiment of the present invention, the high-frequency frequency response regulation module 40 comprises third module plates 41 and fourth module plates 42 spaced apart from each other from up to down; one end of the third module plate 41 and the fourth module plate 42 and the magnetic circuit system 20 respectively have gaps therebetween; the other end of the third module plate 41 and the frame 11 of the back cavity 10 have a gap therebetween; the other end of the fourth module plate 42 is connected to the frame 11 of the back cavity 10. The third module plates 41 and the fourth module plates 42 have gaps therebetween. The fourth module plates 42 and the frame 11 are formed as a piece. For example, plastic and metal are selected to produce the frame 11, and they are formed as one piece. Moreover, a fixed plate 14 is disposed between the magnetic circuit system 20 and the high-frequency frequency response regulation module 40, and provided with a plurality of through holes without influence on flowing of the air flow. The frame 11 and the fixed plate 14 are embedded with a plurality of connecting pieces 13, one end of the third module plate 41 is connected to the fixed plate 14, and the other end is connected to the frame 11 through the connecting pieces 13. One end of the fourth module plate 41 is securely connected to the frame 11, and the other end is connected to the frame 11 through the connecting pieces 13. The connecting pieces 13 are metal wires or net cloths, and the net cloths have a plurality of apertures that have no influence on flowing of the air flow in the back cavity 10. The fixed plate 14 is adapted to the structure of the module plates and the magnetic circuit system 20, and may be a hollow cylinder to surround the magnetic circuit system 20 in the center. The high-frequency frequency response regulation module 40 regulating the air flow passing through the back cavity 10 to be an ascending spiral structure is implemented by adjusting the number of module plates, the gaps between the module plates, the gaps between the module plates, the magnetic circuit system 20 and the frame 11 in the high-frequency frequency response regulation module 40. In the embodiment of the invention, the module plates are ring-shaped, and are adapted to the magnetic circuit system 20 and the back cavity 10. One end of the module plate is an inner side of the ring, and the other end of the module plate is an outer side of the ring. The module plates are respectively secured through the inner side of the ring and the outer side of the ring. For example, one end (the inner side of the ring) of the third module plate 41 is connected to the fixed plate 14, and the other end (the outer side of the ring) is connected to the frame 11 through the connecting pieces 13.

Preferably, the high-frequency frequency response regulation module 40 comprises at least four third module plates 41, and at least comprises at least three fourth module plates 42, gaps between a plurality of the third module plates 41 and the frame 11 are equal or unequal, gaps between the plurality of the third module plates 41 and the magnetic circuit system 20 are equal or unequal, gaps between a plurality of the fourth module plates 42 and the frame 11 are equal or unequal, gaps between the plurality of the fourth module plates 42 and the magnetic circuit system 20 are equal or unequal, and gaps between the plurality of the third module plates 41 and the fourth module plates 42 are equal or unequal. A length of the second effective air passage is regulated by adjusting number of the third module plates 41 and the fourth module plates 42 and sizes of the gaps. For example, increasing or decreasing the number of the third module plates 41 and the fourth module plates 42, and narrowing or widening the gaps between the plurality of fourth module plates 42 and the frame 11 change the length of the second effective air passage to implement adjustment to frequency sensations. For example, after experiments, in a structure of the speaker 100 without the high-frequency frequency response regulation module 40, when the high-frequency frequency of the speaker 100 is 13,433 HZ, peaks are produced. If lengths of the third module plates 41 are reduced till no longer exists, high-frequency expansibility becomes better, i.e., the peaks shown in FIG. 4 move to the right, and regulating the lengths of the third module plates 41 and the fourth module plates 42 can slightly adjust values of the high-frequency resonant peaks.

Figure 4:
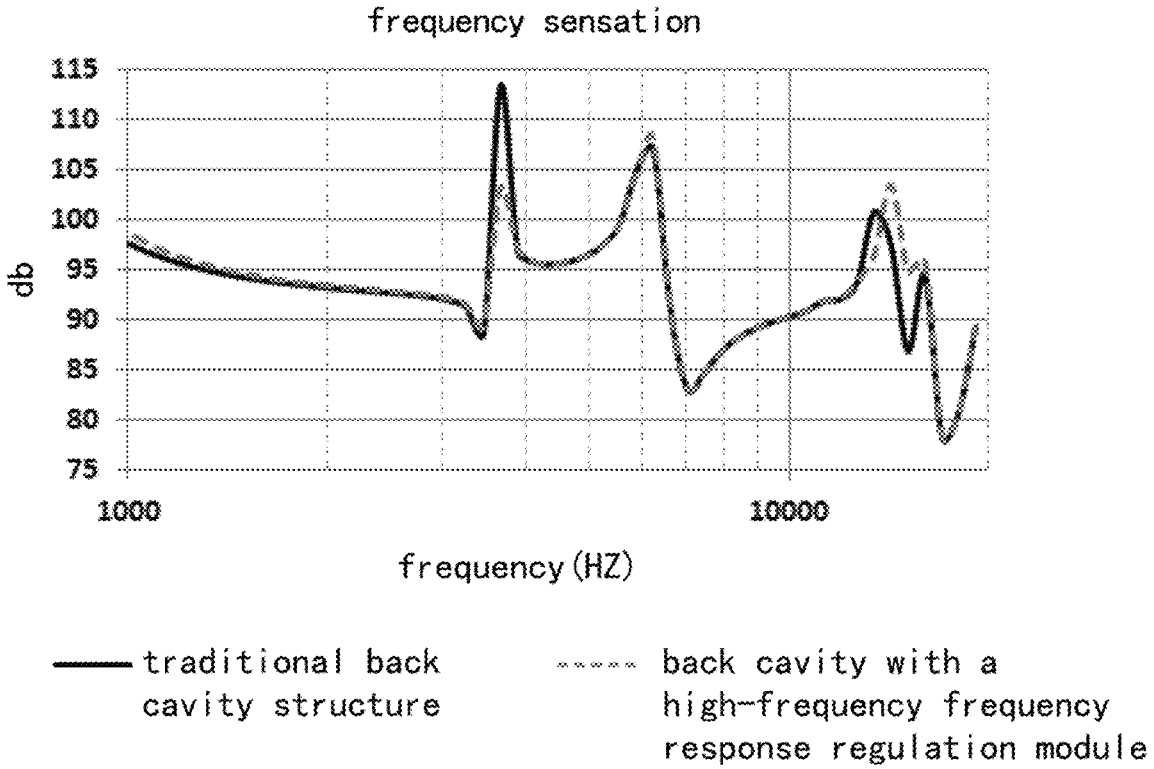
FIG. 4 is a comparison diagram of frequency sensations of the speaker with and without an intermediate-frequency frequency response regulation module provided in the embodiment of the invention.
Figure 5:
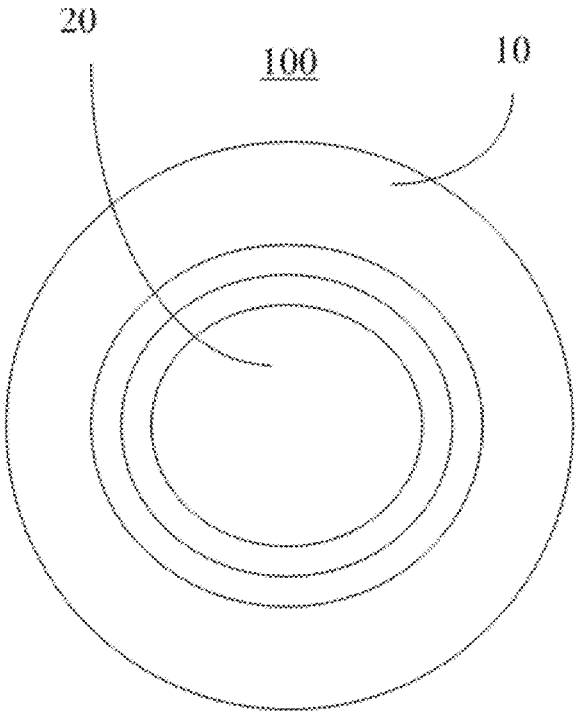
FIG. 5 is a schematic diagram of an external structure of the speaker provided in the embodiment of the invention.

To correspond to extension of the high-frequency sensation, the high-frequency frequency response regulation module 40 of the back cavity 10 is re-designed as shown in FIG. 3, and distribution of the original sound field of the back cavity 10 is changed, thereby changing the high-frequency frequency response of the speaker 100. Here the added high-frequency frequency response regulation module 40 comprises a plurality of module plates, and these module plates are substantially not spiral structures. These module plates are mainly disposed proximate to the lower portion of the back cavity 10, and are sequentially arranged in such a way that one is spaced apart with the frame 11, and one is close to the frame 11 and spaced apart with the magnetic circuit system 20, so the air flow in the back cavity 10 passes through the gaps between the plates and the frame 11, the gaps between adjacent two plates, and the gaps between the plates and the magnetic circuit system 20, which form the second effective air passage, and the air flow passes through the second effective air passage to ascend to form the spiral structure, thereby extending the high-frequency sensation. The module plates might not be necessarily arranged horizontally, and it can be arranged in an inclined way. The distance between the plates, and the distance from the plates to the magnetic circuit system 20 and the frame 11 can be regulated according to actual situations, so as to extend the high-frequency sensation. During regulation of the high-frequency sensation, it substantially won't affect variation of the sensation curves of other frequency bands. The module plates in the high-frequency frequency response regulation module 40 are often solids (copper, iron, etc) with larger hardness, PMMA and the like. Sensation results of the back cavity 10 with and without the high-frequency frequency response regulation module 40 are shown in FIG. 4, where the peaks of the intermediate-frequency sensation become smooth. In addition, the high-frequency sensation is extended and improved.

Referring to FIGS. 1A, 1B, 3 and 5, in one embodiment of the invention, the speaker 100 further comprises a voice coil 50, and the magnetic circuit system 20 comprises a groove 21, where the voice coil 50 is positioned; a top of the back cavity 10 is provided with a dome 12. The frequency response regulation module in the back cavity 10 forms a spiral air flow, which can improve intermediate-frequency sensation and high-frequency sensation of the speaker 100. Such new design changes the inherent cognition of the engineers to the function, so as to provide some guide directions to future design. Addition of the intermediate-frequency frequency response regulation module 30 and/or the high-frequency frequency response regulation module 40 of the back cavity 10 can replace the function of the sound-absorbing cotton to improve the curve of the intermediate-frequency sensation, while avoiding sacrifice (side effects of the sound-absorbing cotton) of some performances. In addition, speaking from production, it may reduce one workstation of sticking the sound-absorbing cotton, which saves costs. Extension of high-frequency sensation may be implemented by regulating design of the high-frequency frequency response regulation module 40 of the back cavity 10, which avoids requirements for high performance materials (large hardness, small density), also replaces the function of dish, while also avoids adverse effect of falling of the intermediate-frequency and high-frequency sensations due to increase of weight.

In order to achieve another object of the invention, the invention further provides an audio device comprising the speaker 100 in any one of embodiments. The audio device comprises earphones, loudspeaker boxes, CD players, recorders and mobile phones. The speaker 100 is provided in these audio devices to obtain a better intermediate-frequency sensation and high-frequency sensation.

Figure 6:
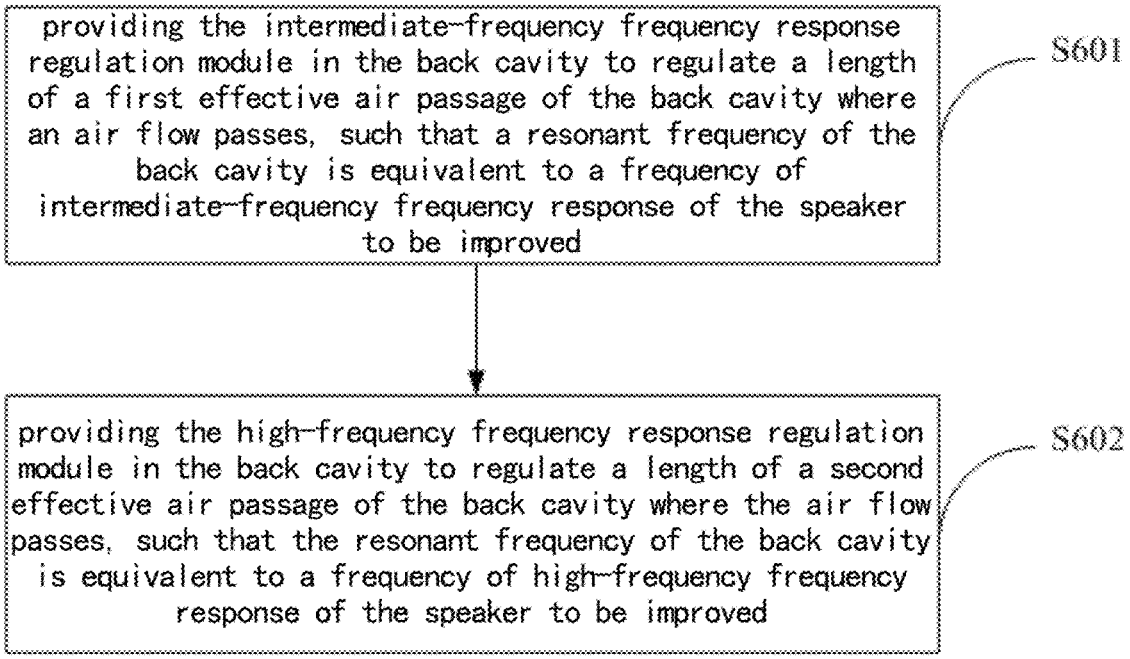
FIG. 6 is a flow diagram of a method of regulating frequency response provided in the embodiment of the invention.

Referring to FIG. 6, in order to achieve still another object of the invention, the invention further provides a method of regulating frequency response comprising the speaker 100 in any one of embodiments, comprising:

In step S601, providing the intermediate-frequency frequency response regulation module 30 in the back cavity 10 to regulate a length of a first effective air passage of the back cavity 10 where an air flow passes, such that a resonant frequency of the back cavity 10 is equivalent to a frequency of intermediate-frequency frequency response of the speaker 100 to be improved; and/or In step S602, providing the high-frequency frequency response regulation module 40 in the back cavity 10 to regulate a length of a second effective air passage of the back cavity 10 where the air flow passes, such that the resonant frequency of the back cavity 10 is equivalent to a frequency of high-frequency frequency response of the speaker 100 to be improved.

The method of regulating frequency response of the speaker 100 provided in this embodiment firstly analyzes which of the intermediate-frequency or high-frequency sensation of the speaker 100 has to be improved, design a special frequency response regulation module inside the back cavity 10 to produce sound field distribution of a local resonance with respect to different requirements for intermediate-frequency and high-frequency sensations of the speaker 100, such that a resonant frequency of the back cavity 10 is equivalent to a frequency of intermediate-frequency frequency response of the speaker 100 to be improved, and/or the resonant frequency of the back cavity 10 is equivalent to a frequency of high-frequency frequency response of the speaker 100 to be improved, thereby improving the corresponding intermediate-frequency frequency response and high-frequency frequency response by producing a local resonant frequency in the back cavity 10. The main working principle of the scheme is based on Fabry-Perot resonance: $k_0 l_{eff} = m\pi$, wherein $k_0$ is vectors of a free wave, and $l_{eff}$ is the length of the effective air passage, wherein m is an integer. The resonant frequency can be represented as $$f_0 = \frac{mc_0}{2l_{eff}}.$$

As can be seen, regulation of the resonant frequency $f_0$ is mainly implemented by adjusting $l_{eff}$ (the length of the effective air passage). When the intermediate-frequency frequency response regulation module 30 and/or the high-frequency frequency response regulation module 40 are not disposed in the original back cavity 10, the length of the effective air passage of the back cavity 10 where the air flow passes is relatively fixed. The length of the effective air passage of the back cavity 10 where the air flow passes is adjusted to regulate intermediate-frequency frequency response and high-frequency frequency response by setting different intermediate-frequency frequency response regulation module 30 and high-frequency frequency response regulation module 40 in the back cavity 10. The intermediate-frequency frequency response regulation module 30 regulates the air flow passing through the back cavity 10 to be an ascending spiral structure to improve the intermediate-frequency sensation of the speaker 100, and the high-frequency frequency response regulation module 40 regulates the air flow passing through the back cavity 10 to be an ascending spiral structure to improve the high-frequency sensation of the speaker 100. The air flow in the back cavity 10 is formed to be an ascending spiral structure to improve acoustic performance of the speaker 100. When the intermediate-frequency or high-frequency sensation is regulated, addition of the frequency response regulation modules almost has no influence on other performance of the speaker 100

Specifically, the intermediate-frequency frequency response regulation module 30 is disposed in a lower portion of the back cavity 10, and the intermediate-frequency frequency response regulation module 30 comprises a plurality of module plates arranged horizontally or at a preset angle. The high-frequency frequency response regulation module 40 is disposed in the lower portion of the back cavity 10 and/or on one side close to a frame 11 of the back cavity 10, and the high-frequency frequency response regulation module 40 comprises a plurality of module plates arranged horizontally or at a preset angle.

Preferably, the intermediate-frequency frequency response regulation module 30 comprises first module plates 31 and second module plates 32 spaced apart from each other from up to down; one end of the first module plate 31 is connected to the magnetic circuit system 20, and the other end and the frame 11 of the back cavity 10 have a gap therebetween; one end of the second module plate 32 and the magnetic circuit system 20 have a gap therebetween, and the other end is connected to the frame 11 of the back cavity 10; the first module plates 31 and the second module plates 32 have gaps therebetween. The intermediate-frequency frequency response regulation module 30 comprises at least two first module plates 31, and at least comprises at least one second module plate 32, gaps between a plurality of the first module plates 31 and the frame 11 are equal or unequal, and gaps between a plurality of the first module plates 31 and the second module plates 32 are equal or unequal. A length of the first effective air passage is regulated by adjusting number of the first module plates 31 and the second module plates 32 and sizes of the gaps.

As for the high-frequency frequency response regulation module 40, it comprises third module plates 41 and fourth module plates 42 spaced apart from each other from up to down; one end of the third module plate 41 and the fourth module plate 42 and the magnetic circuit system 20 respectively have gaps therebetween; the other end of the third module plate 41 and the frame 11 of the back cavity 10 have a gap therebetween; the other end of the fourth module plate 42 is connected to the frame 11 of the back cavity 10. The third module plates 41 and the fourth module plates 42 have gaps therebetween. Preferably, the high-frequency frequency response regulation module 40 comprises at least four third module plates 41, and at least comprises at least three fourth module plates 42, gaps between a plurality of the third module plates 41 and the frame 11 are equal or unequal, gaps between the plurality of the third module plates 41 and the magnetic circuit system 20 are equal or unequal, gaps between a plurality of the fourth module plates 42 and the frame 11 are equal or unequal, gaps between the plurality of the fourth module plates 42 and the magnetic circuit system 20 are equal or unequal, and gaps between the plurality of the third module plates 41 and the fourth module plates 42 are equal or unequal. A length of the second effective air passage is regulated by adjusting number of the third module plates 41 and the fourth module plates 42 and sizes of the gaps. For example, increasing or decreasing the number of the third module plates 41 and the fourth module plates 42, and narrowing or widening the gaps between the plurality of fourth module plates 42 and the frame 11 change the length of the second effective air passage.

To sum up, the invention regulates lengths of the effective air passages in the back cavity by setting an intermediate-frequency frequency response regulation module and/or a high-frequency frequency response regulation module in the back cavity of the speaker, such that the air flow forms a spiral air flow when passing through the back cavity, and intermediate-frequency sensation and high-frequency sensation of the speaker are improved. Moreover, addition of the intermediate-frequency frequency response regulation module and/or the high-frequency frequency response regulation module in the back cavity can replace the function of the sound-absorbing cotton to improve the curve of the intermediate-frequency sensation, while avoiding sacrifice of some performances, such as, side effects of the sound-absorbing cotton. In addition, speaking from production, it may reduce one workstation of sticking the sound-absorbing cotton, which saves costs. Extension of high-frequency sensation may be implemented by regulating design of the high-frequency frequency response regulation module, which avoids requirements for high performance materials (large hardness, small density), also replaces the function of dish, while also avoids adverse effect of falling of the intermediate-frequency and high-frequency sensations due to increase of weight.

Of course, the invention also may have several other embodiments, and the persons skilled in the art shall make various corresponding modifications and variations according to the invention without departing from the spirit and substance of the invention, but these corresponding modifications and variations shall belong to the protection scope of the appended claims in the invention.

What is claimed is:

1. A speaker, comprising a back cavity and a magnetic circuit system connected to the back cavity, and further comprising:

an intermediate-frequency frequency response regulation module disposed in the back cavity for regulating a length of a first effective air passage of the back cavity where an air flow passes, such that a resonant frequency of the back cavity is equivalent to a frequency of intermediate-frequency frequency response of the speaker to be improved; or a high-frequency frequency response regulation module disposed in the back cavity for regulating a length of a second effective air passage of the back cavity where the air flow passes, such that the resonant frequency of the back cavity is equivalent to a frequency of high-frequency frequency response of the speaker to be improved;

wherein the intermediate-frequency frequency response regulation module comprises first module plates and second module plates spaced apart from each other from up to down; one end of the first module plate is connected to the magnetic circuit system, and the other end and a frame of the back cavity have a gap therebetween; one end of the second module plate and the magnetic circuit system have a gap therebetween, and the other end is connected to the frame of the back cavity;

the first module plates and the second module plates have gaps therebetween.

2. The speaker according to claim 1, wherein the intermediate-frequency frequency response regulation module is the intermediate-frequency frequency response regulation module that regulates the air flow passing through the back cavity to be an ascending spiral structure to improve an intermediate-frequency sensation of the speaker; or the high-frequency frequency response regulation module is the high-frequency frequency response regulation module that regulates the air flow passing through the back cavity to be an ascending spiral structure to improve a high-frequency sensation of the speaker.

3. The speaker according to claim 1, wherein the intermediate-frequency frequency response regulation module is disposed in a lower portion of the back cavity; the intermediate-frequency frequency response regulation module comprises a plurality of module plates arranged horizontally or at a preset angle; or the high-frequency frequency response regulation module is disposed in the lower portion of the back cavity or on one side close to the frame of the back cavity; the high-frequency frequency response regulation module comprises a plurality of module plates arranged horizontally or at a preset angle.

4. The speaker according to claim 1, wherein the first module plates and the magnetic circuit system are formed as one piece; or the second module plates and the frame are formed as one piece; or the frame is embedded with a plurality of connecting pieces, one end of the first module plate is connected to the magnetic circuit system, and the other end is connected to the frame through the connecting pieces.

5. The speaker according to claim 4, wherein the connecting pieces are metal wires or net cloths;

the intermediate-frequency frequency response regulation module comprises at least two first module plates, and at least comprises at least one second module plate;

gaps between a plurality of the first module plates and the frame are equal or unequal;

gaps between a plurality of the first module plates and the second module plates are equal or unequal;

a length of the first effective air passage is regulated by adjusting number of the first module plates and the second module plates and sizes of the gaps.

6. The speaker according to claim 3, wherein the high-frequency frequency response regulation module comprises third module plates and fourth module plates spaced apart from each other from up to down; one end of the third module plate and the fourth module plate and the magnetic circuit system respectively have gaps therebetween; the other end of the third module plate and the frame of the back cavity have a gap therebetween; the other end of the fourth module plate is connected to the frame of the back cavity;

the third module plates and the fourth module plates have gaps therebetween.

7. The speaker according to claim 6, wherein the fourth module plates and the frame are formed as a piece; or a fixed plate is disposed between the magnetic circuit system and the high-frequency frequency response regulation module, and provided with a plurality of through holes, the frame and the fixed plate are embedded with a plurality of connecting pieces, one end of the third module plate is connected to the fixed plate, and the other end is connected to the frame through the connecting pieces;

one end of the fourth module plate is securely connected to the frame, and the other end is connected to the frame through the connecting pieces.

8. The speaker according to claim 7, wherein the connecting pieces are metal wires or net cloths; the high-frequency frequency response regulation module comprises at least four third module plates, and at least comprises at least three fourth module plates;

gaps between a plurality of the third module plates and the frame are equal or unequal;

gaps between the plurality of the third module plates and the magnetic circuit system are equal or unequal;

gaps between a plurality of the fourth module plates and the frame are equal or unequal;

gaps between the plurality of the fourth module plates and the magnetic circuit system are equal or unequal;

gaps between the plurality of the third module plates and the fourth module plates are equal or unequal;

a length of the second effective air passage is regulated by adjusting number of the third module plates and the fourth module plates and sizes of the gaps.

9. The speaker according to claim 3, wherein the module plates are ring-shaped, and are adapted to the magnetic circuit system and the back cavity; one end of the module plate is an inner side of the ring, and the other end of the module plate is an outer side of the ring.

10. The speaker according to claim 3, wherein the speaker further comprises a voice coil, and the magnetic circuit system comprises a groove, where the voice coil is positioned;

a top of the back cavity is provided with a dome having a dish; a material of the module plates is metallic copper, metallic iron or polymethyl methacrylate.

11. The speaker according to claim 1, wherein a computing formula of the $$f_0 = \frac{mc_0}{2l_{eff}},$$

resonant frequency is wherein $f_0$ is the resonant frequency, $c_0$ is vectors of a free wave, and $l_{eff}$ is the length of the effective air passage, wherein m is an integer.

12. An audio device comprising the speaker according to claim 1.

13. The audio device according to claim 12, wherein the audio device is earphones, loudspeaker boxes, CD players, recorders or mobile communication terminals.

14. A method of regulating frequency response for the speaker according to claim 1, comprising:

providing the intermediate-frequency frequency response regulation module in the back cavity to regulate a length of a first effective air passage of the back cavity where an air flow passes, such that a resonant frequency of the back cavity is equivalent to a frequency of intermediate-frequency frequency response of the speaker to be improved; or providing the high-frequency frequency response regulation module in the back cavity to regulate a length of a second effective air passage of the back cavity where the air flow passes, such that the resonant frequency of the back cavity is equivalent to a frequency of high-frequency frequency response of the speaker to be improved.

* * * * *